US006221430B1

(12) United States Patent
Tompsett

(10) Patent No.: US 6,221,430 B1
(45) Date of Patent: Apr. 24, 2001

(54) PROCESS FOR MAKING A DETERGENT PARTICLE

(75) Inventor: Michael Frederick Tompsett, Jesmond (GB)

(73) Assignee: The Procter & Gamble Company, Cincinnati, OH (US)

( * ) Notice: Subject to any disclaimer, the term of this patent is extended or adjusted under 35 U.S.C. 154(b) by 580 days.

(21) Appl. No.: 08/625,445

(22) Filed: Mar. 28, 1996

(30) Foreign Application Priority Data

Apr. 13, 1995 (GB) ..... 9507756

(51) Int. Cl.[7] ..... B05D 1/02

(52) U.S. Cl. ..... 427/212; 427/220; 427/421; 510/108; 510/441; 510/511

(58) Field of Search ..... 427/212, 215, 427/220, 421; 510/375, 108, 441, 442, 509, 510, 511

(56) References Cited

U.S. PATENT DOCUMENTS 4,097,418 * 6/1978 Rolfes ..... 510/349
4,434,068 * 2/1984 Delwel et al. ..... 510/349
4,721,633 * 1/1988 Baldassin ..... 427/212
4,863,632 * 9/1989 Aronson et al. ..... 252/186.35
5,605,883 * 2/1997 Iliff et al. ..... 510/356

FOREIGN PATENT DOCUMENTS 0 522 766 A2 1/1993 (EP) .
1 465 519 2/1977 (GB) .
1 481 229 7/1977 (GB) .
63-284299 11/1988 (JP) .

* cited by examiner

*Primary Examiner*—Shrive Beck
*Assistant Examiner*—Bret B. Chen
(74) *Attorney, Agent, or Firm*—Brian M. Bolam; Kim William Zerby; Steven W. Miller

(57) ABSTRACT

There is provided a process for applying a coating to a base particle comprising a hygroscopic material, particularly sodium silicate, comprising
the steps of (i) spraying an aqueous mixture comprising organic binder and optionally a dyestuff onto the base particle; and (ii) drying the particle to obtain a finished particle wherein the weight ratio of hygroscopic material to organic binder in the finished particle is from 1000:1 to 10:1, expressed on a dry weight basis. Detergent compositions containing the resulting particles are also provided.

4 Claims, No Drawings

PROCESS FOR MAKING A DETERGENT PARTICLE

TECHNICAL FIELD

The present invention relates to a process for applying a full or partial coating to particles of hygroscopic material, and to detergent compositions adapted for use in machine dishwashing containing such coated particles.

BACKGROUND TO THE INVENTION

Compositions designed for use in automatic dishwasher machines are well known, and a consistent effort has been made by detergent manufacturers to improve the cleaning and/or rinsing efficiency of said compositions on chinaware, glassware and silverware, as reflected by numerous patent publications.

Particulate detergent compositions are, in general, designed to be white in colour. It has however, been seen to be desirable to include in such compositions, at low levels, particles coloured with various dyestuffs, which are commonly known as 'speckle' particles.

Most commonly, speckle particles are based on enzyme-containing prills to which coloured dyestuffs have been applied. This has the disadvantage to the formulator of a detergent product that the amount of speckle, and hence colour in the product is related to the in-product level of the enzyme component whose stain removal performance is highly sensitive to its level of inclusion. Varying the level of the enzyme to achieve the desirable level of speckle effect in product can thus have a major impact on the peformance of the detergent product.

In choosing an alternative speckle base/substrate the formulator faces a problem that such substrate should have no negative effect on the detergent performance of the product, and preferably should contribute to the detergency performance.

The fomulator is also faced with the problem that the speckle should have good abrasion colour stability, that is good resistance to dye abrasion (e.g. in any further packaging/processing steps). Similarly, the colour of the speckle should be resistant to being washed off in any further processing steps involving liquid application, e.g. by spraying-on, steps. The speckle furthermore should possess good in-product colour storage stability including resistance to oxidation and other processes which may cause degradation of the dyestuff.

The Applicants have now found that particles of hygroscopic material, particularly silicate material, are especially suitable speckle substrates. It has also been found that improved abrasion colour stability, stability to liquid spray contact and in-product storage stability may be achieved when the speckle is made by a process whereby an aqueous mixture of an organic binder and the dyestuff ar e sprayed onto base particles of hygroscopic material, and subsequently dried.

Surprisingly, the Applicants have also found that when such a silicate-containing speckle material is incorporated as part of a silicate-based alkalinity system, in place of a significant proportion of the usual (non-speckle) silicate, prevention of filming and clouding benefits on glassware are obtained. Such benefits are furthermore obtainable even in the absence of the dyestuff (i.e. with just the organic binder applied to the base hygroscopic particle).

SUMMARY OF THE INVENTION

There is provided a process for applying a coating to a base particle comprising a hygroscopic material comprising the steps of (i) spraying an aqueous mixture comprising organic binder and optionally a dyestuff onto the base particle; and (ii) drying the particle to obtain a finished particle wherein the weight ratio of hygroscopic material to organic binder in the finished particle is from 1000:1 to 10:1, expressed on a dry weight basis.

The hygroscopic material is preferably sodium silicate having an $SiO_2$:$Na_2O$ ratio of from 1.0 to 3.0.

According to another aspect of the present invention there is provided a detergent composition containing (i) a water soluble builder compound; and (ii) sodium silicate having an $SiO_2$:$Na_2O$ ratio of from 1.0 to 3.0 present at a level of from 0.5% to 20% $SiO_2$ by weight of the composition wherein sodium silicate providing at least 5% by weight of the total $SiO_2$ to the composition is in the form of the coated silicate particles according to the process aspect of the invention. The pH of a 1% solution of the detergent composition measured at 20° C. is preferably from 9.0 to 11.5.

DETAILED DESCRIPTION OF THE INVENTION

The process according to the present invention provides a method of applying a coating to a base particle.

The process comprises the essential steps of (i) spraying an aqueous mixture comprising organic binder and optionally a dyestuff onto the base particle; and (ii) drying the particle to obtain a finished particle.

Hygroscopic Material

In an essential aspect the base particle comprises a hygroscopic material, that is a material which tends to absorb moisture, particularly from the atmosphere.

It is believed that the hygroscopic nature of the material is important to the working of the process in that when the aqueous mixture of the binder, and optionally the dyestuff, are sprayed onto the base particle its hygroscopic nature tends to draw the water into the particle, thus leaving a relatively even 'coating' of binder and dyestuff on the surface of the particle.

It has been established that particularly suitable hygroscopic materials are those having structures with a relatively small pore size, especially those having a pore size of less than 15 $\mu$m.

The preferred hygroscopic material is sodium silicate having an $SiO_2$:$Na_2O$ ratio of from 1.0 to 3.0, preferably from 1.6 to 2.4, most preferably 2.0. The alkali metal silicate may be in the form of either the anhydrous salt or a hydrated salt.

Other suitable hygroscopic materials include certain clays, aluminosilicates, silica and crystalline layered silicates.

Organic Binder

The aqueous mixture to be sprayed onto the base particle contains, in an essential aspect, an organic binder.

The weight ratio of hygroscopic material to organic binder in the finished particle is from 1000:1 to 10:1 preferably from 500:1 to 50:1, expressed on a dry weight basis.

Examples of suitable organic binders include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Preferred examples of such compounds are the polymers which contain acrylic acid, that is to say homopolymers of acrylic acid and copolymers with any suitable other monomer units, and which have a average molecular weight of from 2,000 to 100,000. Suitable other monomer units include modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Preferred are the copolymers of acrylic acid and maleic anhydride having a average molecular weight of from 20,000 to 100,000.

Preferred acrylic acid containing polymers have an average molecular weight of less than 15,000, and include those sold under the tradename Sokalan PA30, PA20, PA15, PA10 and Sokalan CP10 by BASF GmbH, and those sold under the tradename Acusol 45N by Rohm and Haas.

Other preferred acrylic acid containing copolymers include those which contain as monomer units: a) from 90% to 10%, preferably from 80% to 20% by weight acrylic acid or its salts and b) from 10% to 90%, preferably from 20% to 80% by weight of a substituted acrylic monomer or its salts having the general formula —[$CR_2$—$CR_1$(CO—O—$R_3$)]— wherein at least one of the substituents $R_1$, $R_2$ or $R_3$, preferably $R_1$ or $R_2$ is a 1 to 4 carbon alkyl or hydroxyalkyl group, $R_1$ or $R_2$ can be a hydrogen and $R_3$ can be a hydrogen or alkali metal salt. Most preferred is a substituted acrylic monomer wherein $R_1$ is methyl, $R_2$ is hydrogen (i.e. a methacrylic acid monomer). The most preferred copolymer of this type has a average molecular weight of from 4500 to 3000 and contains 60% to 80% by weight of acrylic acid and 40% to 20% by weight of methacrylic acid.

The polyamino compounds are useful as organic binders herein including those derived from aspartic acid such as those disclosed in EP-A-305282, EP-A-305283 and EP-A-351629.

Other suitable binders include the $C_{10}$–$C_{20}$ alcohol ethoxylates containing from 5–100 moles of ethylene oxide per mole of alcohol and more preferably the $C_{15}$–$C_{20}$ primary alcohol ethoxylates containing from 20–100 moles of ethylene oxide per mole of alcohol.

Other preferred binders include certain polymeric materials. Polyvinylpyrrolidones with an average average molecular weight of from 12,000 to 700,000 and polyethylene glycols (PEG) with an average average molecular weight of from 600 to $5\times10^6$ preferably 1000 to 400,000 most preferably 1000 to 10,000 are examples of such polymeric materials. Copolymers of maleic anhydride with ethylene, methylvinyl ether or methacrylic acid, the maleic anhydride constituting at least 20 mole percent of the polymer are further examples of polymeric materials useful as binder agents. These polymeric materials may be used as such or in combination with solvents such as water, propylene glycol and the above mentioned $C_{10}$–$C_{20}$ alcohol ethoxylates containing from 5–100 moles of ethylene oxide per mole. Further examples of binders include the $C_{10}$–$C_{20}$ mono- and diglycerol ethers and also the $C_{10}$–$C_{20}$ fatty acids.

Dyestuff

In a preferred aspect, the aqueous mixture containing the organic binder also contains a dyestuff. The weight ratio of hygroscopic material to dyestuff, where present, in the finished particle is from 1000:1 to 50:1, preferably from 500:1 to 100:1 expressed on a dry weight basis.

The dyestuff can be any suitable dyestuff, particularly organic based dyestuffs which have found common usage in the preparation of coloured 'speckle' particles for inclusion in detergent products. Specific examples of suitable dyestuffs include E104—food yellow 13 (quinoline yellow), E110—food yellow 3 (sunset yellow FCF), E131—food blue 5 (patent blue V), E133—food blue 2 (brilliant blue FCF), E140—natural green 3 (chlorophyll and chlorphyllins), E141 and Pigment green 7 (chlorinated Cu phthalocyanine).

Making Process

The process according to the present invention involves treating a base particle to provide a partially or fully coated 'finished' particle.

The process includes two steps namely a spraying-on step and a drying step. These may be carried out in stepwise fashion, or alternatively both steps may occur simultaneously.

The spraying-on step comprises spraying an aqueous mixture comprising organic binder and optionally a dyestuff onto the base particle. This spraying-on can be achieved by any spraying process commonly known to the person skilled in the art. The spraying-on step is preferably carried out slowly to allow the base granule to adsorp the mixture, and absorb the water part of the aqueous mixture.

Preferably, the spraying-on is carried out whilst the particles are agitated by some means. Suitable agitation means comprise drum mixers, KM Loedige (tradename) mixers, V blenders, spray granulators, fluidised beds, turbodisers (tradename) and Schugi (tradename) mixers.

The drying step involves drying the particles obtained from the first step. This drying process may be carried out using any known drying apparatus such as fluidised bed driers and granulator driers.

In one preferred aspect the spraying-on and drying steps occur simultaneously, most preferably being carried out as a continuous process in a fluidised bed drier.

The finished particles preferably have a moisture content of from 0.5% to 15%, preferably from 5% to 10%, by weight of the finished particle.

Detergent Compositions

According to a further aspect of the present invention there are provided detergent compositions, which are particularly adapted for use in a machine dishwashing method. Such compositions are formulated to enable the removal of, typically food based, soils and stains from soiled tableware under the conditions present in a machine dishwasher. Typically the compositions are low foaming, preferably containing only low levels of low-foaming surfactants.

The detergent composition contains (i) a water soluble builder compound; and (ii) an alkalinity system comprising sodium silicate having an $SiO_2$:$Na_2O$ ratio of from 1.0 to 3.0 present at a level of from 0.5% to 20% $SiO_2$ by weight of the composition.

It has been found that the total level of $SiO_2$ should be kept to less than 20% in that the use of too high levels of $SiO_2$ in a formulation can lead to problems associated with permanent clouding and iridescence on the surface of any glassware in the wash. The sodium silicate is preferably present in the composition at a level of from 2% to 15%, most preferably from 3% to 12% by weight of $SiO_2$. The alkali metal silicate may be in the form of either the anhydrous salt or a hydrated salt.

According to one preferred aspect, the alkalinity system preferably contains only sodium silicate having an $SiO_2$:$Na_2O$ ratio of from 1.6 to 3.0, preferably from 1.6 to 2.4, most preferably 2.0.

According to another preferred aspect the alkalinity system also contains sodium metasilicate, present at a level of at least 0.4% $SiO_2$ by weight. Sodium metasilicate has a nominal $SiO_2$:$Na_2O$ ratio of 1.0. The weight ratio of said sodium silicate to said sodium metasilicate, measured as $SiO_2$, is then from 50:1 to 5:4, preferably from 20:1 to 3:2, more preferably from 15:1 to 2:1, most preferably from 10:1 to 5:2.

In an essential aspect, the sodium silicate providing at least 10%, preferably at least 15%, most preferably at least 25% by weight of the total $SiO_2$ to the composition is in the form of the 'finished' silicate particles made in accord with the process aspect of the invention.

Water-soluble Builder Compound

The compositions of the present invention may contain as a highly preferred component a water-soluble builder compound, typically present at a level of from 1% to 80% by weight, preferably from 10% to 70% by weight, most preferably from 20% to 60% by weight of the composition.

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, carbonates, bicarbonates, borates, phosphates, and mixtures of any of the foregoing.

The carboxylate or polycarboxylate builder can be momomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydrofuran-cis,cis,cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343.

Of the above, the preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures a re also contemplated as useful builder components.

Borate builders, as well as builders containing borate-forming materials that can produce borate under detergent storage or wash conditions can also be used but are not preferred at wash conditions less that about 50° C., especially less than about 40° C.

Examples of carbonate builders are the alkaline earth and alkali metal carbonates, including sodium carbonate and sesqui-carbonate and mixtures thereof with ultra-fine calcium carbonate as disclosed in German Patent Application No. 2,321,001 published on Nov. 15, 1973.

Specific examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

pH of the Compositions

In a preferred aspect the present compositions have a pH measured as a 1% solution in distilled water at 20° C. of from 9.0 to 11.5, preferably from 9.5 to 11.2, most preferably from 10.0 to 11.0.

Optional Detergent Ingredients

In addition to the essential ingredients described hereinabove, the compositions of the invention may be formulated as detergent compositions comprising additional detergent ingredients, preferably selected from oxygen bleachinmg systems, surfactants, heavy metal ion sequestrants, crystal growth inhibitors, enzymes, organic polymeric compounds, corrosion inhibitors, and suds suppressors.

Oxygen-releasing Bleaching System

A preferred component of the compositions in accord with the invention is an oxygen-releasing bleaching system. In a preferred aspect the bleaching system comprises a hydrogen peroxide source and a peroxyacid bleach precursor compound. The production of the peroxyacid occurs by an in situ reaction of the precursor with a source of hydrogen peroxide. Suitable sources of hydrogen peroxide include inorganic perhydrate bleaches.

Inorganic Perhydrate Bleaches

The compositions preferably include a hydrogen peroxide source, as an oxygen-releasing bleach. Suitable hydrogen peroxide sources include the inorganic perhydrate salts.

The inorganic perhydrate salts are normally incorporated in the form of the sodium salt at a level of from 1% to 40% by weight, more preferably from 2% to 30% by weight and most preferably from 5% to 25% by weight of the compositions.

Examples of inorganic perhydrate salts include perborate, percarbonate, perphosphate, persulfate and persilicate salts. The inorganic perhydrate salts are normally the alkali metal salts. The inorganic perhydrate salt may be included as the crystalline solid without additional protection. For certain perhydrate salts however, the preferred executions of such granular compositions utilize a coated form of the material which provides better storage stability for the perhydrate salt in the granular product.

Sodium perborate can be in the form of the monohydrate of nominal formula $NaBO_2H_2O_2$ or the tetrahydrate $NaBO_2H_2O_2.3H_2O$.

Sodium percarbonate, which is a preferred perhydrate for inclusion in compositions in accordance with the invention, is an addition compound having a formula typically corresponding to $2Na_2CO_3.3H_2O_2$, and is available commercially as a crystalline solid. The percarbonate is most preferably incorporated into such compositions in a coated form which provides in product stability.

A suitable coating material providing in product stability comprises mixed salt of a water soluble alkali metal sulphate and carbonate. Such coatings together with coating processes have previously been described in GB-1,466,799, granted to Interox on Mar. 9, 1977. The weight ratio of the mixed salt coating material to percarbonate lies in the range from 1 200 to 1:4, more preferably from 1:99 to 1:9, and most preferably from 1:49 to 1:19. Preferably, the mixed salt is of sodium sulphate and sodium carbonate which has the general formula $Na_2SO_4.n.Na_2CO_3$ wherein n is form 0.1 to 3, preferably n is from 0.3 to 1.0 and most preferably n is from 0.2 to 0.5.

Another suitable, and preferred, coating material contains sodium silicate having an $SiO_2$:$Na_2O$ of from 1.6 to 3.0 and/or sodium metasilicate. Where present as a coating material, such sodium silicate and/or sodium metasilicate can perform three functions, namely: enhancing storage stability of the perhydrate salt, delaying dissolution of the perhydrate salt and hence release of hydrogen peroxide to the wash solution, and providing $SiO_2$ to the wash solution as part of the alkalinity system in accord with the invention.

Other coatings which contain silicate (alone or with borate salts or boric acids or other inorganics), waxes, oils, fatty soaps can also be used advantageously within the present invention.

Potassium peroxymonopersulfate is another inorganic perhydrate salt of use in the detergent compositions herein.

Peroxyacid Bleach Precursor

Peroxyacid bleach precursors are preferably incorporated at a level of from 0.5% to 20% by weight, more preferably from 1% to 15% by weight, most preferably from 1.5% to 10% by weight of the compositions.

Suitable peroxyacid bleach precursors typically contain one or more N- or O- acyl groups, which precursors can be selected from a wide range of classes. Suitable classes include anhydrides, esters, imides and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Suitable peroxyacid bleach precursor compounds include the N-acylated lactams, perbenzoic acid and perbenzoic acid derivative precurosrs, peroxyacid precursors and alkyl fatty acid precursor compounds described in more detail hereinafter.

N-acylated Lactam Precursor Compound

N-acylated precursor compounds of the lactam class are disclosed generally in GB-A-855735. Whilst the broadest aspect of the invention contemplates the use of any lactam useful as a peroxyacid precursor, preferred materials comprise the caprolactams and valerolactams.

Suitable N-acylated lactam precursors have the formula:

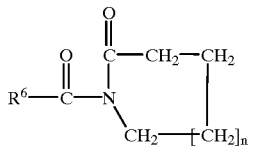

wherein n is from 0 to about 8, preferably from 0 to 2, and $R^6$ is H, an alkyl, aryl, alkoxyaryl or alkaryl group containing from 1 to 12 carbons, or a substituted phenyl group containing from 6 to 18 carbon atoms Suitable caprolactam bleach precursors are of the formula:

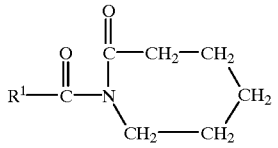

wherein $R^1$ is H or an alkyl, aryl, alkoxyaryl or alkaryl group containing from 1 to 12 carbon atoms, preferably from 6 to 12 carbon atoms, most preferably $R^1$ is phenyl.

Suitable valero lactams have the formula:

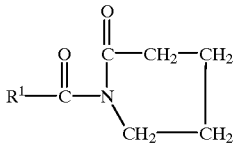

wherein $R^1$ is H or an alkyl, aryl, alkoxyaryl or alkaryl group containing from 1 to 12 carbon atoms, preferably from 6 to 12 carbon atoms. In highly preferred embodiments, $R^1$ is selected from phenyl, heptyl, octyl, nonyl, 2,4,4-trimethylpentyl, decenyl and mixtures thereof.

The most preferred materials are those which are normally solid at <30° C., particularly the phenyl derivatives, ie. benzoyl valerolactam, benzoyl caprolactam and their substituted benzoyl analogues such as chloro, amino alkyl, alkyl, aryl and alkoxy derivatives.

Caprolactam and valerolactam precursor materials wherein the $R^1$ moiety contains at least 6, preferably from 6 to 12, carbon atoms provide peroxyacids on perhydrolysis of a hydrophobic character which afford nucleophilic and body soil clean-up. Precursor compounds wherein $R^1$ comprises from 1 to 6 carbon atoms provide hydrophilic bleaching species which are particularly efficient for bleaching beverage stains. Mixtures of 'hydrophobic' and 'hydrophilic' caprolactams and valero lactams, typically at weight ratios of 1:5 to 5:1, preferably 1:1, can be used herein for mixed stain removal benefits.

Highly preferred caprolactam and valerolactam precursors include benzoyl caprolactam, nonanoyl capro-lactam, benzoyl valerolactam, nonanoyl valerolactam, 3,5,5-trimethylhexanoyl caprolactam, 3,5,5-trimethylhexanoyl valerolactam, octanoyl caprolactam, octanoyl valerolactam, decanoyl caprolactam, decanoyl valerolactam, undecenoyl caprolactam, undecenoyl valerolactam, (6-octanamidocaproyl)oxybenzene-sulfonate, (6-nonanamidocaproyl)oxybenzenesulfonate, (6-decanamidocaproyl)-oxybenzenesulfonate, and mixtures thereof. Examples of highly preferred substituted benzoyl lactams include methylbenzoyl caprolactam, methylbenzoyl valerolactam, ethylbenzoyl caprolactam, ethylbenzoyl valerolactam, propylbenzoyl caprolactam, propylbenzoyl valerolactam, isopropylbenzoyl caprolactam, isopropylbenzoyl valerolactam, butylbenzoyl caprolactam, butylbenzoyl valerolactam, tert-butylbenzoyl caprolactam, tert-butylbenzoyl valerolactam, pentylbenzoyl caprolactam, pentylbenzoyl valerolactam, hexylbenzoyl caprolactam, hexylbenzoyl valerolactam, ethoxybenzoyl caprolactam, ethoxybenzoyl valerolactam, propoxybenzoyl caprolactam, propoxybenzoyl valerolactam, isopropoxybenzoyl caprolactam, isopropoxybenzoyl valerolactam, butoxybenzoyl caprolactam, butoxybenzoyl valerolactam, tert-butoxybenzoyl caprolactam, tert-butoxybenzoyl valerolactam, pentoxybenzoyl caprolactam, pentoxybenzoyl valerolactam, hexoxybenzoyl caprolactam, hexoxybenzoyl valerolactam, 2,4,6-trichlorobenzoyl caprolactam, 2,4,6-trichlorobenzoyl valerolactam, pentafluorobenzoyl caprolactam, pentafluorobenzoyl valerolactam, dichlorobenzoyl caprolactam, dimethoxybenzoyl caprolactam, 4-chlorobenzoyl caprolactam, 2,4-dichlororbenzoyl caprolactam, terephthaloyl dicaprolactam, pentafluorobenzoyl caprolactam, pentafluorobenzoyl valerolactam, dichlorobenzoyl valerolactam, dimethoxybenzoyl valerolactam, 4-chlorobenzoyl valerolactam, 2,4-dichlororbenzoyl valerolactam, terephthaloyl divalerolactam, 4-nitrobenzoyl caprolactam, 4-nitrobenzoyl valerolactam, and mixtures thereof.

Perbenzoic Acid Precursor

Essentially any perbenzoic acid precursors are suitable herein, including those of the N-acylated lactam class, which are preferred.

Suitable O-acylated perbenzoic acid precursor compounds include the substituted and unsubstituted benzoyl oxybenzene sulfonates, including for example benzoyl oxybenzene sulfonate:

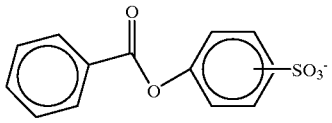

Also suitable are the benzoylation products of sorbitol, glucose, and all saccharides with benzoylating agents, including for example:

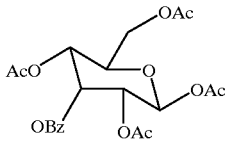

Ac=$COCH_3$; Bz=Benzoyl

Preferred perbenzoic acid precursor compounds of the imide type include N-benzoyl succinimide, tetrabenzoyl ethylene diamine and the N-benzoyl substituted ureas. Suitable imidazole type perbenzoic acid precursors include N-benzoyl imidazole and N-benzoyl benzimidazole and other useful N-acyl group-containing perbenzoic acid precursors include N-benzoyl pyrrolidone, dibenzoyl taurine and benzoyl pyroglutamic acid.

Preferred perbenzoic acid precursors include the benzoyl diacyl peroxides, the benzoyl tetraacyl peroxides, and the compound having the formula:

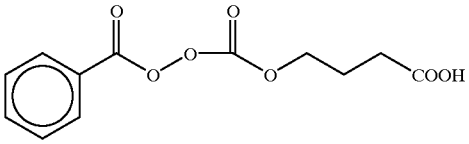

Phthalic anhydride is another suitable perbenzoic acid precursor compound herein:

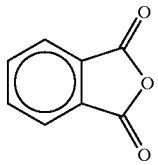

Perbenzoic Acid Derivative Precursors

Suitable perbenzoic acid derivative precursors include any of the herein disclosed perbenzoic precursors in which the perbenzoic group is substituted by essentially any functional group including alkyl groups.

Another preferred class of substituted perbenzoic acid precursor compounds are the amide substituted compounds of the following general formulae:

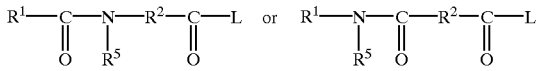

wherein $R^1$ is an aryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms and L can be essentially any leaving group. $R^1$ preferably contains from 6 to 12 carbon atoms. $R^2$ preferably contains from 4 to 8 carbon atoms. $R^1$ may be aryl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms in total. Amide substituted bleach activator compounds of this type are described in EP-A-0170386.

The L group must be sufficiently reactive for the reaction to occur within the optimum time frame (e.g., a wash cycle). However, if L is too reactive, this activator will be difficult to stabilize for use in a bleaching composition. These characteristics are generally paralleled by the pKa of the conjugate acid of the leaving group, although exceptions to this convention are known. Ordinarily, leaving groups that exhibit such behaviour are those in which their conjugate acid has a pKa in the range of from 4 to 13, preferably from 6 to 11 and most preferably from 8 to Preferred bleach precursors are those wherein $R^1$, $R^2$ and $R^5$ are as defined for the amide substituted compounds and L is selected from the group consisting of:

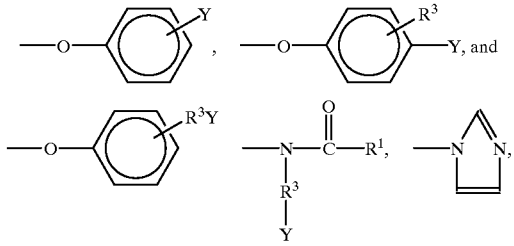

-continued

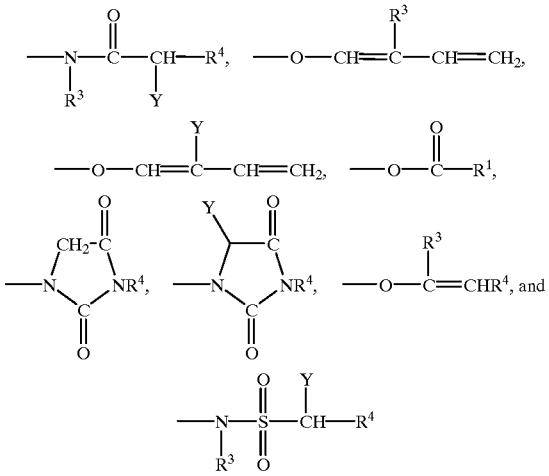

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, and Y is H or a solubilizing group.

The preferred solubilizing groups are $—SO_3^-M^+$, $—CO_2^-M^+$, $—SO_4^-M^+$, $—N^+(R^3)_4X^-$ and $O<—N(R^3)_3$ and most preferably $—SO_3^-M^+$ and $—CO_2^-M$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion. It should be noted that bleach activators with a leaving group that does not contain a solubilizing groups should be well dispersed in the bleaching solution in order to assist in their dissolution.

Cationic Peroxyacid Precursors

Cationic peroxyacid precursor compounds are also suitable herein. Typically such cationic peroxyacid precursors are formed by substituting the peroxyacid part with an ammonium or alkyl ammmonium group, preferably an ethyl or methyl ammonium group.

Cationic peroxyacid precursors are described in U.S. Pat. Nos. 4,904,406; 4,751,015; 4,988,451; 4,397,757; 5,269,962; 5,127,852; 5,093,022; 5,106,528; U.K. 1,382,594; EP 475,512, 458,396 and 284,292; and in JP 87-318,332.

Examples of preferred cationic peroxyacid precursors are described in UK Patent Application No. 9407944.9 and U.S. patent application Ser. Nos. 08/298903, 08/298650, 08/298904 and 08/298906.

Suitable cationic peroxyacid precursors include any of the ammonium or alkyl ammonium substituted alkyl or benzoyl oxybenzene sulfonates, N-acylated caprolactams, and monobenzoyltetraacetyl glucose benzoyl peroxides.

A preferred cationically substituted benzoyl oxybenzene sulfonate is the 4-(trimethyl ammonium) methyl derivative of benzoyl oxybenzene sulfonate:

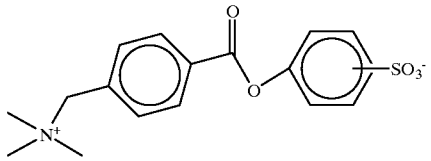

A preferred cationically substituted alkyl oxybenzene sulfonate is the methyl ammonium derivative of 2,3,3-trimethyl hexanoyloxybenzene sulfonate.

Preferred cationic peroxyacid precursors of the N-acylated caprolactam class include the trialkyl ammonium methylene benzoyl caprolactams, particularly trimethyl ammonium methylene benzoyl caprolactam:

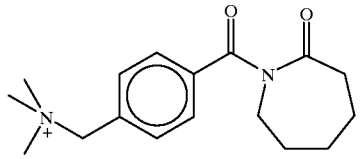

Another preferred cationic peroxyacid precursor is 2-(N,N,N-trimethyl ammonium) ethyl sodium 4-sulphophenyl carbonate chloride.

Alkyl Fatty Peroxyacid Bleach Precursors

Alkyl fatty peroxyacid bleach precursors form alkyl fatty peroxyacids on perhydrolysis. Preferred precursors of this type give rise to peracetic acid on perhydrolysis.

Preferred alkyl fatty peroxyacid precursor compounds of the imide type include the N-,N,$N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred.

Another preferred class of peroxyacid bleach activator compounds are the amide substituted compounds of the following general formulae:

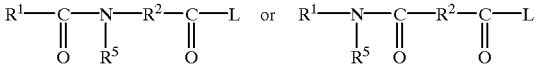

wherein $R^1$ is an alkyl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms and L can be essentially any leaving group. $R^1$ preferably contains from 6 to 12 carbon atoms. $R^2$ preferably contains from 4 to 8 carbon atoms. $R^1$ may be straight chain or branched alkyl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms in total. L may be selected from any of the leaving groups described hereinbefore for the analogues having $R^1$ as an aryl or alkaryl group. Amide substituted bleach activator compounds of this type are described in EP-A-0170386.

Organic Peroxyacids

The compositions may also contain, as oxygen-releasing bleaches, organic peroxyacids, typically at a level of from 1% to 15% by weight, more preferably from 1% to 10% by weight of the composition.

A preferred class of organic peroxyacid compounds are the amide substituted compounds of the following general formulae:

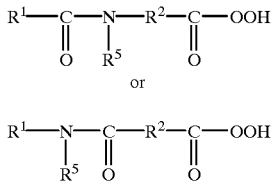

wherein $R^1$ is an alkyl, aryl or alkaryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms. $R^1$ preferably contains from 6 to 12 carbon atoms. $R^2$ preferably contains from 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms in total. Amide substituted organic peroxyacid compounds of this type are described in EP-A-0170386.

Other organic peroxyacids include diperoxydodecanedioc acid, diperoxytetra decanedioc acid, diperoxyhexadecanedioc acid, mono- and diperazelaic acid, mono- and diperbrassylic acid, monoperoxy phthalic acid and its magnesium salt, perbenzoic acid, and their salts as disclosed in, for example, EP-A-0341 947.

Partially Soluble or Insoluble Builder Compound

The compositions of the present invention may less preferably contain a partially soluble or insoluble builder compound. Examples of partially water soluble builders include the crystalline layered silicates as disclosed for example, in EP-A-0164514, DE-A-3417649 and DE-A-3742043. Examples of largely water insoluble builders include the sodium aluminosilicates, including Zeolite A, Zeolite B, Zeolite P, Zeolite X, Zeoilte MAP, Zeolite HS and mixtures thereof.

Surfactant

A highly preferred component of the compositions of the invention is a surfactant system comprising surfactant selected from anionic, cationic, nonionic ampholytic and zwitterionic surfactants and mixtures thereof. Preferably the surfactant system comprises low foaming surfactant, which is typically nonionic in character. The surfactant system is typically present at a level of from 0.2% to 30% by weight, more preferably from 0.5% to 10% by weight, most preferably from 1% to 5% by weight of the compositions.

A typical listing of anionic, nonionic, ampholytic and zwitterionic classes, and species of these surfactants, is given in U.S. Pat. No. 3,929,678 issued to Laughlin and Heuring on Dec. 30, 1975. A list of suitable cationic surfactants is given in U.S. Pat. No. 4,259,217 issued to Murphy on Mar. 31, 1981. A listing of surfactants typically included in automatic dishwashing detergent compositions is given for example, in EP-A-0414 549 and PCT Applications No.s WO 93/08876 (attorney's docket no. CM465M) and WO 93/08874 (attorney's docket no. CM595M).

Nonionic Surfactant

Essentially any nonionic surfactants useful for detersive purposes can be included in the compositions. Preferred, non-limiting classes of useful nonionic surfactants are listed below.

Nonionic Ethoxylated Alcohol Surfactant

The alkyl ethoxylate condensation products of aliphatic alcohols with from about 1 to about 25 moles of ethylene oxide are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from about 2 to about 10 moles of ethylene oxide per mole of alcohol.

Nonionic ethoxylated/propoxylated fatty alcohol surfactant

The ethoxylated $C_6$–$C_{18}$ fatty alcohols and $C_6$–$C_{18}$ mixed ethoxylated/propoxylated fatty alcohols are suitable surfactants for use herein, particularly where water soluble. Preferably the ethoxylated fatty alcohols are the $C_{10}$–$C_{18}$ ethoxylated fatty alcohols with a degree of ethoxylation of from 3 to 50, most preferably these are the $C_{12}$–$C_{18}$ ethoxylated fatty alcohols with a degree of ethoxylation from 3 to 40. Preferably the mixed ethoxylated/propoxylated fatty alcohols have an alkyl chain length of from 10 to 18 carbon atoms, a degree of ethoxylation of from 3 to 30 and a degree of propoxylation of from 1 to 10.

Nonionic EO/PO Condensates with Propylene Glycol

The condensation products of ethylene oxide with a hydrophobic base formed by the condensation of propylene oxide with propylene glycol are suitable for use herein. The hydrophobic portion of these compounds preferably has a average molecular weight of from about 1500 to about 1800 and exhibits water insolubility. Examples of compounds of this type include certain of the commercially-available Pluronic™ surfactants, marketed by BASF.

Nonionic EO Condensation Products with Propylene Oxide/Ethylene Diamine Adducts

The condensation products of ethylene oxide with the product resulting from the reaction of propylene oxide and ethylenediamine are suitable for use herein. The hydrophobic moiety of these products consists of the reaction product of ethylenediamine and excess propylene oxide, and generally has a average molecular weight of from about 2500 to about 3000. Examples of this type of nonionic surfactant include certain of the commercially available Tetronic™ compounds, marketed by BASF.

Heavy Metal Ion Sequestrant

The detergent compositions of the invention preferably contain as an optional component a heavy metal ion sequestrant. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 20%, preferably from 0.1% to 10%, more preferably from 0.25% to 7.5% and most preferably from 0.5% to 5% by weight of the compositions.

Heavy metal ion sequestrants, which are acidic in nature, having for example phosphonic acid or carboxylic acid functionalities, may be present either in their acid form or as a complex/salt with a suitable counter cation such as an alkali or alkaline metal ion, ammonium, or substituted ammonium ion, or any mixtures thereof. Preferably any salts/complexes are water soluble. The molar ratio of said counter cation to the heavy metal ion sequestrant is preferably at least 1:1.

Suitable heavy metal ion sequestrants for use herein include organic phosphonates, such as the amino alkylene poly (alkylene phosphonates), alkali metal ethane 1-hydroxy disphosphonates and nitrilo trimethylene phosphonates. Preferred among the above species are diethylene triamine penta (methylene phosphonate), ethylene diamine tri (methylene phosphonate) hexamethylene diamine tetra (methylene phosphonate) and hydroxy-ethylene 1,1 diphosphonate.

Other suitable heavy metal ion sequestrant for use herein include nitrilotriacetic acid and polyaminocarboxylic acids such as ethylenediaminotetracetic acid, ethylenetriamine pentacetic acid, ethylenediamine disuccinic acid, ethylenediamine diglutaric acid, 2-hydroxypropylenediamine disuccinic acid or any salts thereof.

Especially preferred is ethylenediamine-N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt or complex thereof.

Crystal Growth Inhibitor Component

The detergent compositions preferably contain a crystal growth inhibitor component, preferably an organodiphosphonic acid component, incorporated preferably at a level of from 0.01% to 5%, more preferably from 0.1% to 1% by weight of the compositions.

By organo diphosphonic acid it is meant herein an organo diphosphonic acid which does not contain nitrogen as part of its chemical structure. This definition therefore excludes the organo aminophosphonates, which however may be included in compositions of the invention as heavy metal ion sequestrant components.

The organo diphosphonic acid is preferably a $C_1$–$C_4$ diphosphonic acid, more preferably a C2 diphosphonic acid, such as ethylene diphosphonic acid, or most preferably ethane 1-hydroxy-1,1-diphosphonic acid (HEDP) and may be present in partially or fully ionized form, particularly as a salt or complex.

Enzyme

Another optional ingredient useful in the compositions is one or more enzymes. Preferred enzymatic materials include the commercially available lipases, amylases, neutral and alkaline proteases, esterases, cellulases, pectinases, lactases and peroxidases conventionally incorporated into detergent compositions. Suitable enzymes are discussed in U.S. Pat. Nos. 3,519,570 and 3,533,139.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Protease enzyme may be incorporated into the compositions in accordance with the invention at a level of from 0.0001% to 4% active enzyme by weight of the composition.

Preferred amylases include, for example, a-amylases obtained from a special strain of B licheniformis, described in more detail in GB-1,269,839 (Novo). Preferred commercially available amylases include for example, those sold under the tradename Rapidase by Gist-Brocades, and those sold under the tradename Termamyl and BAN by Novo Industries A/S. Amylase enzyme may be incorporated into the composition in accordance with the invention at a level of from 0.0001% to 2% active enzyme by weight of the composition.

Lipolytic enzyme (lipase) may be present at levels of active lipolytic enzyme of from 0.0001% to 2% by weight, preferably 0.001% to 1% by weight, most preferably from 0.001% to 0.5% by weight of the compositions. The lipase may be fungal or bacterial in origin. Lipase from chemically or genetically modified mutants of these strains are also useful herein. A preferred lipase is described in Granted European Patent, EP-B-0218272.

An especially preferred lipase herein is obtained by cloning the gene from *Humicola lanuginosa* and expressing the gene in *Aspergillus oryza*, as host, as described in European Patent Application, EP-A-0258 068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

Enzyme Stabilizing System

Preferred enzyme-containing compositions herein may comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such stabilizing systems can comprise calcium ion, boric acid, propylene glycol, short chain carboxylic acid, boronic acid, chlorine bleach scavengers and mixtures thereof. Such stabilizing systems can also comprise reversible enzyme inhibitors, such as reversible protease inhibitors.

Organic Polymeric Compound

Organic polymeric compounds may be added as preferred separate components of the compositions in accord with the invention. In addition such organic polymeric compounds may find use as organic binders in the process aspect of the invention as described hereinbefore. By organic polymeric compound it is meant essentially any polymeric organic compound commonly used as dispersants, and anti-redeposition and soil suspension agents in detergent compositions.

Organic polymeric compound is typically incorporated in the detergent compositions of the invention at a level of from 0.1% to 30%, preferably from 0.5% to 15%, most preferably from 1% to 10% by weight of the compositions.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of average molecular weight 2000–10000 and their copolymers with any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Preferred are the copolymers of acrylic acid and maleic anhydride having a average molecular weight of from 20,000 to 100,000.

Preferred commercially available acrylic acid containing polymers having a average molecular weight below 15,000 include those sold under the tradename Sokalan PA30, PA20, PA15, PA10 and Sokalan CP10 by BASF GmbH, and those sold under the tradename Acusol 45N by Rohm and Haas.

Preferred acrylic acid containing copolymers include those which contain as monomer units: a) from 90% to 10%, preferably from 80% to 20% by weight acrylic acid or its salts and b) from 10% to 90%, preferably from 20% to 80% by weight of a substituted acrylic monomer or its salts having the general formula —[$CR_2$—$CR_1$(CO—O—$R_3$)]— wherein at least one of the substituents $R_1$, $R_2$ or $R_3$, preferably $R_1$ or $R_2$ is a 1 to 4 carbon alkyl or hydroxyalkyl group, $R_1$ or $R_2$ can be a hydrogen and $R_3$ can be a hydrogen or alkali metal salt. Most preferred is a substituted acrylic monomer wherein $R_1$ is methyl, $R_2$ is hydrogen (i.e. a methacrylic acid monomer). The most preferred copolymer of this type has a average molecular weight of 3500 and contains 60% to 80% by weight of acrylic acid and 40% to 20% by weight of methacrylic acid.

The polyamino compounds are useful herein including those derived from aspartic acid such as those disclosed in EP-A-305282, EP-A-305283 and EP-A-351629.

Lime Soap Dispersant Compound

The compositions of the invention may contain a lime soap dispersant compound, preferably present at a level of from 0.1% to 40% by weight, more preferably 1% to 20% by weight, most preferably from 2% to 10% by weight of the compositions.

A lime soap dispersant is a material that prevents the precipitation of alkali metal, ammonium or amine salts of fatty acids by calcium or magnesium ions. Preferred lime soap disperant compounds are disclosed in PCT Application No. WO93/08877 (attorney's docket no. CM466M).

Suds Suppressing System

The compositions of the invention, when formulated for use in machine washing compositions, preferably comprise a suds suppressing system present at a level of from 0.01% to 15%, preferably from 0.05% to 10%, most preferably from 0.1% to 5% by weight of the composition.

Suitable suds suppressing systems for use herein may comprise essentially any known antifoam compound, including, for example silicone antifoam compounds, 2-alkyl and alcanol antifoam compounds. Preferred suds suppressing systems and antifoam compounds are disclosed in PCT Application No. WO93/08876 (attorney's docket no. CM465M) and copending European Application No. 93870132.3 (attorney's docket no. CM562F).

Polymeric Dye Transfer Inhibiting Agents

The compositions herein may also comprise from 0.01% to 10%, preferably from 0.05% to 0.5% by weight of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidonepolymers or combinations thereof.

Corrosion Inhibitor

The compositions may contain corrosion inhibitors such as benzotriazole and paraffin. Suitable corrosion inhibitors are described in PCT Application No. WO94/07981 and copending European Application No. EP 93202095.1.

Form of the Compositions

The bulk density of granular detergent compositions in accordance with the present invention is typically of at least 650 g/liter, more usually at least 700 g/liter and more preferably from 800 g/liter to 1200 g/liter.

The particle size of the components of granular compositions in accordance with the invention should preferably be such that no more that 5% of particles are greater than 1.4 mm in diameter and not more than 5% of particles are less than 0.15 mm in diameter.

Washing Method

Any suitable methods for washing or cleaning soiled tableware, including soiled patterned glassware and silverware, are envisaged including machine dishwashing methods.

Machine Dishwashing Method

A preferred machine dishwashing method comprises treating soiled articles selected from crockery, glassware, hollowware, silverware and cutlery and mixtures thereof, with an aqueous liquid having dissolved or dispensed therein an effective amount of a machine dishwashing composition in accord with the invention. By an effective amount of the machine dishwashing composition it is meant from 8 g to 60 g of product dissolved or dispersed in a wash solution of volume from 3 to 10 liters, as are typical product dosages and wash solution volumes commonly employed in conventional machine dishwashing methods.

In the detergent compositions, the abbreviated component identifications have the following meanings:

| | |
|---|---|
| Nonionic | $C_{13}$–$C_{15}$ mixed ethoxylated/propoxylated fatty alcohol with an average degree of ethoxylation of 3.8 and an average degree of propoxylation of 4.5 sold under the tradename Plurafac LF404 by BASF Gmbh (low foaming) |
| Metasilicate | Sodium metasilicate ($SiO_2$:$Na_2O$ ratio = 1.0) |
| Granular silicate | Amorphous Sodium Silicate ($SiO_2$:$Na_2O$ ratio = 2.0) in uncoated form |
| Carbonate | Anhydrous sodium carbonate |
| Phosphate | Sodium tripolyphosphate |
| 480N | Random copolymer of 3:7 acrylic/methacrylic acid, average average molecular weight about 3,500 |
| PA 30 | Hompolymer of acrylic acid having an average molecular weight of about 4,500 |
| Citrate | Tri-sodium citrate dihydrate |
| PB1 | Anydrous sodium perborate monohydrate |
| PB4 | Anhydrous sodium perborate tetrahydrate |
| TAED | Tetraacetyl ethylene diamine |
| DETPMP | Diethylene triamine penta (methylene phosphonic acid), marketed by Monsanto under the tradename Dequest 2060 |
| HEDP | Ethane 1-hydroxy-1,1-diphosphonic acid |
| Paraffin | Paraffin oil sold under the tradename Winog 70 by Wintershall. |
| Protease | Proteolytic enzyme sold under the tradename Savinase by Novo Industries A/S (approx 2% enzyme activity). |
| Amylase | Amylolytic enzyme sold under the tradename Termamyl 60T by Novo Industries A/S (approx 0.9% enzyme activity) |
| BSA | Amylolytic enzyme sold under the tradename LE17 by Novo Industries A/S (approx 1% enzyme activity) |
| Sulphate | Anhydrous sodium sulphate. |
| pH | Measured as a 1% solution in distilled water at 20° C. |

In the following examples all levels of enzyme quoted are expressed as % active enzyme by weight of the composition.

EXAMPLE 1

A green silicate speckle was made in accord with the invention as follows:

An aqueous mixture of organic binder and two dyestuffs was made up by adding with continuous mixing 2.44 kg of E104—quinoline yellow, 0.16 kg of E131—patent blue V and 10.53 kg of 480N to 100 kg of water. Continuous agitation of the mixture is necessary to keep the dyesuffs evenly dispersed in the suspension.

The 113.13 kg of aqueous mixture, made as above, was sprayed onto 1000 kg of coarse grade base 2.0 ratio silicate particles of mean particle size 600 to 700 $\mu$m in a spray-on drum. The resulting 'wet speckles' were then dried in a fluidised bed dryer to give finished particles, hereinafter 'green speckle 1' having the composition:

| | |
|---|---|
| Silicate | 95% |
| 480N | 1% |
| E 104 | 0.232% |
| E131 | 0.015% |
| Water | 3.753% |

EXAMPLE 2

A second batch of silicate speckle, was made up using identical process steps to Example 1, other than that Pigment Green 7 was used instead of E104 and E131 to give a speckle, hereinafter 'green speckle 2', having the composition:

| | |
|---|---|
| Silicate | 95.45% |
| 480N | 0.5% |
| Pigment Green 7 | 0.14% |
| Water | 4.91% |

EXAMPLE 3

The following machine dishwashing detergent compositions were prepared (parts by weight). Compositions A and D are comparative compositions, compositions B, C and E to G are in accord with the invention.

| | A | B | C | D | E | F | G |
|---|---|---|---|---|---|---|---|
| Citrate | 29.0 | 29.0 | 15.0 | — | — | — | 15.0 |
| 480 N | — | — | 6.0 | — | — | 4.0 | 6.0 |
| PA 30 | 3.7 | 3.7 | — | — | — | — | — |
| Carbonate | — | — | 17.5 | 30.5 | 30.5 | — | 17.5 |
| Phosphate | — | — | — | 30.0 | 30.0 | 53.0 | — |
| Granular silicate (as $SiO_2$) | 17.0 | 16.0 | 5.0 | 4.0 | 3.0 | 10.0 | 6.0 |
| Silicate speckle# (as $SiO_2$) | — | 1.0 | 1.0 | — | 1.0 | 4.0 | 2.0 |
| Metasilicate (as $SiO_2$) | — | — | 2.5 | — | — | 5.0 | 1.2 |
| PB1 (AvO) | 0.3 | 0.3 | 0.3 | 1.4 | 1.4 | 1.2 | 0.3 |
| PB4 (AvO) | 0.9 | 0.9 | 0.9 | — | — | — | 0.9 |
| TAED | 4.4 | 4.4 | 2.2 | 1.0 | 1.0 | 2.2 | 2.2 |
| Protease | 0.04 | 0.04 | 0.04 | 0.04 | 0.04 | 0.04 | 0.04 |
| Amylase | 0.03 | 0.03 | 0.03 | 0.03 | 0.03 | 0.03 | 0.03 |
| BSA | — | — | — | — | — | — | 0.03 |
| DETPMP | 0.13 | 0.13 | 0.13 | — | — | — | 0.13 |
| HEDP | 0.5 | 0.5 | 1.0 | — | — | — | 1.0 |
| Nonionic misc inc sulphate/ moisture to balance | 1.5 | 1.5 | 2.0 | 0.75 | 0.75 | 2.0 | 2.0 |
| pH (1% solution) | 10.7 | 10.7 | 10.8 | 10.3 | 10.3 | 11.0 | 10.7 |

Green speckle# = 'green speckle 1' of Example 1

Comparative Testing—Glassware Pattern Protection

The glass pattern protection performance of Compositions B and E, in accord with the invention was compared to that of comparative Compositions A and D using the following three hundred-cycle test procedure.

In testing each composition, a set of twelve household glasses was placed in the upper rack of a Bosch Siemens SMS6032 (tradename) machine dishwasher. The 65° C. wash setting was selected, the wash process comprising main wash and rinse cycles. 20 grams of compositions A and B, and 40 grams of compositions D and E was employed respectively, for each complete wash process. Additionally 54 g of a representative food soil was added to each machine. The feed water hardness was 18° German Hardness (321 ppm $CaCO_3$ equivalent). Dishwasher salt was employed to reduce the in wash water hardness to about 2° German Hardness (36 ppm $CaCNa_3$ equivalent). The set of twelve glasses was washed three hundred times, with a period of cooling, in which the dishwsaher door was left open, being allowed between each complete wash cycle.

At the end of the three hundredth wash process the glasses were removed and then graded for glass filming and clouding effects. The grading was performed by 2 expert graders and the results averaged for each of the twelve glasses. Grading was through visual inspection for both filming and removable clouding according to the following scales

| | | | |
|---|---|---|---|
| Filming: | 3 = worst | to | 9 = no filming |
| Clouding: | 2 = worst | to | 10 = no clouding |

Results were as follows: (average of the 2 gradings from the panellists)

| | A | B | D | E |
|---|---|---|---|---|
| Filming | 6.0 | 7.0 | 6.5 | 8.0 |
| Clouding | 4.1 | 6.4 | 7.8 | 7.6 |

The overall glass protection profile of Compositions B and E is hence seen to be better than that of related comparative Compositions A and D.

EXAMPLE 4

Compositions are made up having identical compositions to those of B, C and E to G of Example 3, other than that the 'green speckle 1' is replaced by the 'green speckle 2' of Example 2 at identical levels of incorporation.

What is claimed is:

1. A process for producing a speckle particle for use in a detergent composition comprising the steps of:

(i) spraying an aqueous organic binder mixture comprising an acrylic acid copolymer having an average molecular weight of from about 3,000 to about 4,500 and a dyestuff onto a hygrosopic base particle to form a coated particle; and (ii) drying said coated particle to obtain said speckle particle;

wherein the weight ratio of said hygroscopic base particle to said dyestuff in said speckle particle is from about 1,000:1 to about 50:1, expressed on a dry weight basis.

2. A process according to claim 1, wherein said hygroscopic base particle has a pore size of less than 15 $\mu$m.

3. A process according to claim 1, wherein said hygroscopic base particle is sodium silicate having an $SiO_2$:$Na_2O$ ratio of from about 1.0 to about 3.0.

4. A process according to claim 1, wherein said acrylic acid copolymer comprises from about 60% to about 80% by weight of acrylic acid and from about 40% to about 20% by weight of methacrylic acid.

* * * * *